US007198181B2

(12) United States Patent
Richard et al.

(10) Patent No.: US 7,198,181 B2
(45) Date of Patent: Apr. 3, 2007

(54) STOPPER FOR RELIABLE GAS INJECTION

(75) Inventors: François-Noël Richard, Vicherey (FR); Eric Hanse, Henri Bosselin (FR)

(73) Assignee: Vesuvius Crucible Company, Wilmington, DE (US)

( * ) Notice: Subject to any disclaimer, the term of this patent is extended or adjusted under 35 U.S.C. 154(b) by 103 days.

(21) Appl. No.: 10/480,329

(22) PCT Filed: Jun. 12, 2002

(86) PCT No.: PCT/BE02/00096

§ 371 (c)(1),
(2), (4) Date: Dec. 11, 2003

(87) PCT Pub. No.: WO02/100579

PCT Pub. Date: Dec. 19, 2002

(65) Prior Publication Data

US 2004/0164465 A1 Aug. 26, 2004

(30) Foreign Application Priority Data

Jun. 12, 2001 (EP) ..... 01870126

(51) Int. Cl.
*C21C 5/30* (2006.01)

(52) U.S. Cl. ..... 222/602; 222/603; 266/217; 266/220

(58) Field of Classification Search ..... 222/590, 222/602, 603; 266/217, 220
See application file for complete search history.

(56) References Cited

U.S. PATENT DOCUMENTS

| | | | | |
|---|---|---|---|---|
| 3,200,457 | A * | 8/1965 | Wagstaff | 222/590 |
| 4,691,901 | A | 9/1987 | Dobner | |
| 4,706,944 | A | 11/1987 | Lee | |
| 4,899,992 | A * | 2/1990 | Thrower et al. | 266/220 |

FOREIGN PATENT DOCUMENTS

| | | | | |
|---|---|---|---|---|
| FR | 2787045 | | 12/1998 | |
| GB | 2254274 | | 10/1992 | |
| GB | 2263427 | A * | 7/1993 | 222/603 |

* cited by examiner

*Primary Examiner*—Scott Kastler
(74) *Attorney, Agent, or Firm*—Thomas J. Clinton; James R. Williams; Donald M. Satina

(57) ABSTRACT

The present invention concerns a mono-block stopper adapted to deliver gas during pouring of molten metal comprising a stopper body having an internal chamber (1) and a gas discharge port (2), a bore (3) connecting the internal chamber (1) to the gas discharge port (2), calibrating means (4) being provided in the bore (3) to provide a restricted path. This stopper is characterised by the fact that the calibrating means comprise a rod (4) having at least one axially-extending gas passages therealong, the gas passage(s) having a section such as to offer a predetermined resistance to flow. The stopper of the invention is far more reliable and can be easily adapted to various operational parameters.

15 Claims, 1 Drawing Sheet

STOPPER FOR RELIABLE GAS INJECTION

FIELD OF THE INVENTION

This invention relates to a mono-block stopper rod used to control the flow of molten metal from a discharge nozzle in a holding vessel during metal teeming.

BACKGROUND OF THE INVENTION

In continuous casting processes, the use of gases injected down the stopper has been shown to have significant benefits on the quality of metal being cast. For example, inert gases such as argon or nitrogen can be injected to reduce the problems due to alumina build-up and clogging or to assist in removing solidification products from the vicinity of the discharge nozzle. Reactive gases may also be employed when the melt composition needs modifying. Conventionally, the stopper is provided with an internal chamber connected to gas supply means on the one end and to a gas discharge port at the other end.

Various systems have been developed to ensure an accurate measured flow of gas is supplied to the stopper. Problems have been encountered with sealing such systems and ensuring that the gas follows its intended path and is not wasted. Stoppers which have proved to be successful in meeting many of these problems are disclosed in EP-A2-358,535, WO-A1-00/30785 and WO-A1-00/30786.

However, even given such valuable improvements, there is a need to address other problems. One such problem is apparent due to the effect during pouring of large volume of melt of metal flowing past the nose of the stopper through the discharge nozzle. A negative pressure can be generated at the stopper tip which can be transmitted through the gas discharge port into the body and back to the supply pipework where it may exploit any inadequate joints causing air suction into the gas stream with significant detriment to the quality of the metal being cast.

Various solutions have been proposed to eliminate this risk which involve restricting the gas flow within the stopper thereby seeking to create a positive pressure within the stopper. For example, a simple restriction between the internal chamber and the gas-discharge port to provide control is known. At the required pressure, the orifice size of the internal chamber was calculated to be between 0.2–0.5 mm in diameter and, as such, is extremely sensitive to blockage by debris or dust carried in the gas stream, thereby causing loss of flow. It is also known to insert a gas permeable plug into the stopper to provide the required restriction to flow and to pressurise the stopper. However, these systems suffer from the problem of changes in the permeable metal comprising a stopper body having an internal chamber and a gas discharge port, a bore connecting the internal chamber to the gas discharge port, calibrating means being provided in the bore to provide a restricted path. The calibrating means are formed by using a sacrificial void former to form a portion of the bore connecting the internal chamber to the gas discharge port thereby providing a restricted slit-like form path which is said to offer a predetermined resistance to flow and tends to maintain a positive pressure within the stopper. However, the formation of a slit-like path made by using a sacrificial void former is extremely unreliable and does not allow the formation of a restriction with a precise predetermined resistance to flow. Further, this formation method does not allow the formation of very narrow passages. It is to be understood that a positive pressure within the stopper means that the pressure is at least equal to the pressure outside the stopper.

According to another known system disclosed for example in FR-A-2,787,045, there is provided a mono-block stopper adapted to deliver gas during pouring of molten metal comprising a stopper body having an internal chamber and a gas discharge port, a bore connecting the internal chamber to the gas discharge port. Calibrating means are provided under the form of a Venturi-tuyere inserted into the internal chamber. Such a design of the calibrating means does not permit flexibility in the manufacturing process. Further, special precautions must be take to avoid the problem of clogging of the Venturi-tuyere for example by dust.

The present invention aims to overcome or at least mitigate the above problems associated with the prior art stoppers and, in particular, their lack of reliability.

According to one aspect, the present invention concerns thus a mono-block stopper adapted to deliver gas during pouring of molten metal comprising a stopper body having an internal chamber and a gas discharge port, a bore connecting the internal chamber to the gas discharge port, calibrating means being provided in the bore to provide a restricted path. This stopper is characterised by the fact that the calibrating means comprise a rod having at least one axially-extending gas passage therealong, the gas passage having a section such as to offer a predetermined resistance to flow.

The predetermined resistance to flow of the gas passages extending along the rod is calculated to permit a very precise and reliable control of the relationship gas-flow/internal pressure and/or to maintain a positive gas pressure within the stopper.

The use of such a rod which can be inserted into the stopper body at the very end of the manufacturing process of the stopper permits an extreme flexibility in the setting up of the "predetermined" resistance to flow so that the stopper of the invention can be adapted to a wide range of operational parameters simply by changing the rod. Furthermore, the rod—being manufactured separately—can received much more attention than if made together with the stopper and is therefore much more reliable. Such rods are available commercially for use as thermocouple sheaths.

Preferably, the rod is made from a gas-impermeable refractory material so that gas leaks at the level of the rod are avoided, thereby increasing the reliability of the calibration. Advantageously, the material is also wear-resistant so that the predetermined resistance to flow remains constant during the entire life of the rod. Suitable materials include mullite, a fired alumino-silicate, alumina re-crystallised alumina, zirconia-alumina and other high-refractory materials having the required properties.

DETAILED DESCRIPTION OF THE INVENTION

Figure 1:
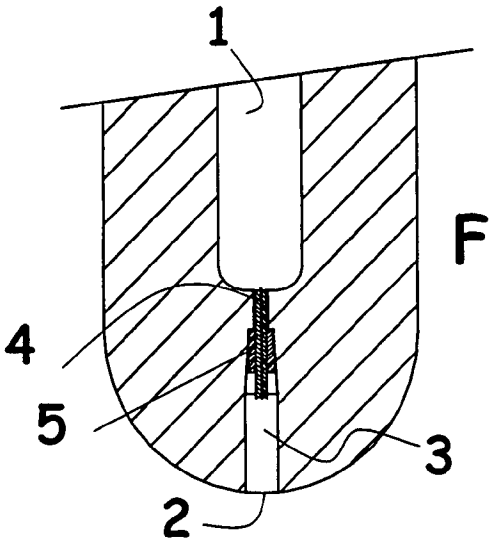
FIG. 1 shows an internal chamber formed inside a stopper body.
Figure 2:
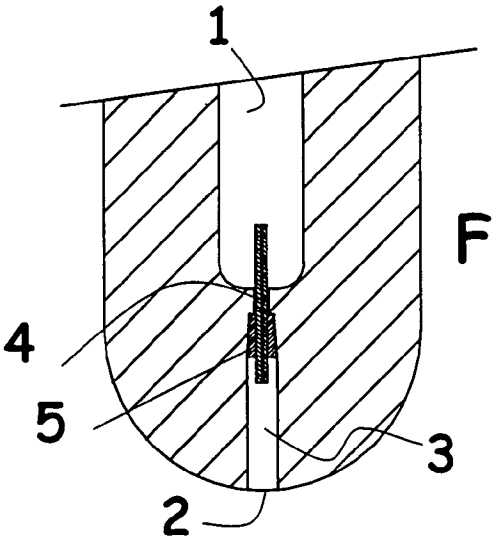
FIG. 2 shows an alternative embodiment with the rod extending above the floor of the internal chamber.

The predetermined resistance to flow of the gas passages extending along the rod is calculated to permit a very precise and reliable control of the relationship gas-flow/internal pressure and/or to maintain a positive gas pressure within the stopper.

The use of such a rod which can be inserted into the stopper body at the very end of the manufacturing process of the stopper permits an extreme flexibility in the setting up of the "predetermined" resistance to flow so that the stopper of the invention can be adapted to a wide range of operational parameters simply by changing the rod. Furthermore, the rod—being manufactured separately—can received much more attention than if made together with the stopper and is therefore much more reliable. Such rods are available commercially for use as thermocouple sheaths.

Preferably, the rod is made from a gas-impermeable refractory material so that gas leaks at the level of the rod are avoided, thereby increasing the reliability of the calibration. Advantageously, the material is also wear-resistant so that the predetermined resistance to flow remains constant during the entire life of the rod. Suitable materials include mullite, a fired alumino-silicate, alumina, re-crystallised alumina, zirconia-alumina and other high-refractory materials having the required properties.

Advantageously, the passage (or the plurality of passages) axially-extending along the rod has (or have) the form of capillary bore(s) or slot(s) so as to increase the loss of pressure. It is however noted that larger gas-passages up to 2 or 3 mm have also been successfully used. In particular, it is advantageous to set up the passages so that the stopper operates in sonic conditions (the gas flows through the passages at a speed at least equal to the sound speed). It is indeed known that in these conditions, a much more reliable gas-flow can be obtained since the gas discharge flow is independent from the outside pressure at the gas-discharge tip and depends only upon the pressure within the stopper or within the gas supply means.

Optionally, a plurality of passages are provided in the rod.

It is noted that the fine-tuning of the calibration can be performed either in varying the total section of the gas passages or the length of the rod.

According to a particularly preferred variant of the invention, the rod projects from the bore beyond the floor of the internal chamber. This arrangement provides indeed a "trap" around the projecting portion of the rod that retains dust and particles present in the stopper so that they cannot clog the gas-passage(s). In this case, the rod should project sufficiently beyond the internal chamber floor to avoid that the particles reach the gas-passages inlet. A height of at least 1 centimeter, preferably, at least 2 centimeters beyond the internal chamber floor permits to achieve this goal.

According to another embodiment of the present invention, a seal, preferably made from a compressible refractory material, is present between at least a portion of the rod and the bore walls. Low density graphite seals are suitable for this use. The seal can be set in place either during the manufacture of the stopper or at a later stage.

It is possible to have the rod extending up to the discharge port; this embodiment is of particular interest when the gas-passages are formed in the rod as capillary bores or slots. This allows to inject the gas into molten metal as fine gas jet instead of large bubbles. In a variant, it is also possible to provide porous material in a portion of the bore which is located between the lower end of the rod and the gas discharge port. In such an arrangement the gas jets are broken and converted into a dispersion of small bubbles. According to a preferred embodiment, a porous plug is inserted into the bore through the gas-discharge port.

Generally, the rod will extend above the floor of the internal chamber of only some centimeters so that the gas passage(s) axially extending therealong communicate(s) with the internal chamber and the gas discharge port. However, in a particular variant, the rod extends up and is connected to gas supply means. In these conditions, the gas supplied to the stopper is directly discharged at the gas discharge port through the gas passage(s) of the rod without even being discharged in the internal chamber. Such an arrangement avoids all gas losses which could be due to the permeability of the stopper material.

The stopper according to the invention can be manufactured according to different manufacturing methods. According to a first method, a rod having at least one axially extending gas passage is copressed with the stopper body. In a preferred variant of this method, a refractory seal is placed around the rod before the copressing step so that the seal is compressed between the rod and the material constituting the stopper body.

According to another manufacturing method, the rod is inserted into the bore at a later stage. The rod can be inserted into the bore through the gas discharge port or through the internal chamber. It is possible to add mortar or cement around the rod to secure it inside the bore. Advantageously, one or several seal can be placed around the rod before its insertion so as to compensate the possible differences in thermal expansion of the different materials. It may be necessary to force the seal into the bore. Preferably, the seal material is protected from oxidation by mortar or cement. The region of the bore intended to receive the seal can be designed conical so that the seal is maintained compressed during its insertion and maintain in compression all along the life of the rod.

The second manufacturing method is preferred for several reasons: it permits to have a standard stopper design which is only adapted at the very end of the manufacturing process to the particular operational parameters, it also avoids the reject due to possible breakage of the calibrated rod during the pressing and subsequent firing operations.

In a particular variant of the second manufacturing method, the lowest region of the bore is internally threaded and designed to receive an externally threaded porous insert. This insert fulfils the function of diffusing the gas into the molten material and of protecting the lower part of the rod (from molten material ingress) and the seal (from oxidation). In this case, the porous plug can also contact the lower part of the seal so that it also contributes to maintain the seal in compression.

In another manufacturing variant corresponding to the case of the rod extending up and connected to the gas supply means, the method further comprises a step of connecting the rod to gas supply means.

Some embodiments of the invention will now be described by way of examples with reference to the accompanying drawings in which FIGS. 1 to 4 are schematic views of the lower part of four stoppers according to different embodiments of the invention.

In these figures, reference 1 depicts the internal chamber formed inside the stopper body. The internal chamber 1 communicates with gas supply means (not shown). The stopper has also a gas discharge port 2 located a the lowest tip of the stopper. A bore 3 connects the internal chamber 1 to the gas discharge port 2. A rod 4 is located in the bore 3. The rod 4 has one or several axially extending gas passages therealong. The total section of the gas passages is calculated so as to offer a predetermined resistance to flow to maintain a positive gas pressure within the stopper. A seal 5 made from low density graphite and placed around the rod 4 permits to avoid gas leaks and thereby increases the reliability of the system.

The rod 4 of the stopper of FIG. 1 levels off the floor of the internal chamber 1. Similar stoppers are depicted on FIGS. 2 to 4, but the rod 4 projects beyond the floor of the internal chamber 1 so that dust and particles present in the internal chamber 1 (for example carried over by the gas stream or created by abrasion inside the stopper) cannot reach the gas passage inlets.

Figure 3:
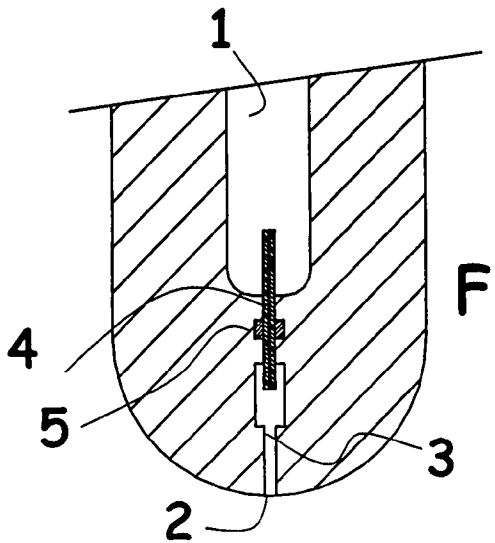
FIG. 3 shows the embodiment of FIG. 2 with a graphite seal.

FIG. 3 shows a particular embodiment wherein the rod 4 and a low density graphite seal 5 have been copressed together with the stopper.

Figure 4:
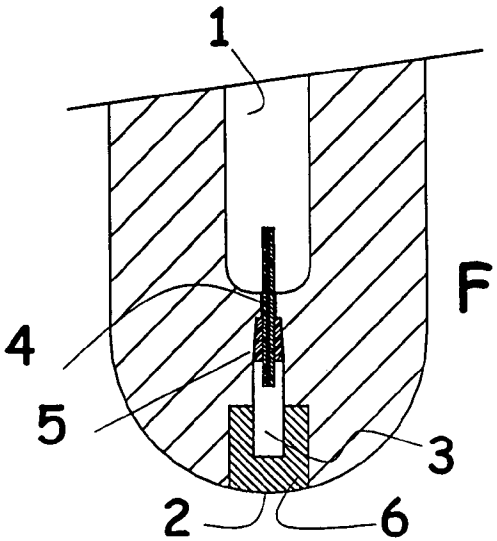
FIG. 4 shows the embodiment of FIG. 3 with a porous plug.

FIG. 4 shows another embodiment wherein a porous plug 6 has been introduced in a hole drilled around the bore 3 at the level of the gas discharge port 2.

REFERENCES

1. Internal chamber
2. Gas discharge port
3. Bore
4. Rod
5. Seal
6. Porous material

The invention claimed is:

1. Mono-block stopper adapted to deliver a flow of gas during pouring of molten metal, the stopper comprising, a lower end, a gas discharge port at the lower end, and an internal surface defining an internal chamber and a bore, the internal chamber having a floor towards the lower end of the stopper, the bore comprising a calibrating rod that fluidly connects the internal chamber and the gas discharge port, the calibrating rod comprising a refractory ceramic material, the calibrating rod extending at least to the floor of the internal chamber and comprising at least one gas passage having a section with a predetermined resistance to the flow and a cross-sectional area less than 10 $mm^2$.

2. Stopper of claim 1, wherein the rod extends above the floor of the internal chamber.

3. Stopper of claim 1, wherein the rod comprises recrystallised alumina.

4. Stopper of claim 1, wherein the passage is selected from the group consisting of capillary bores and slots.

5. Stopper of claim 1, wherein a seal is located around the rod.

6. Stopper of claim 5, wherein the seal consists essentially of a refractory material.

7. Stopper of claim 6, wherein the refractory material comprises graphite.

8. Stopper of claim 1, wherein a porous material is present between the lower end of the rod and the gas discharge port.

9. Stopper according to claim 8, wherein a porous plug is inserted in at least a portion of the bore between the lower end of the rod and the gas discharge port.

10. Stopper of claim 1, wherein the gas passage fluidly communicates with the internal chamber and the gas discharge poll.

11. Stopper of claim 1, wherein the rod is connected to a gas supply line.

12. Process for making a mono-block stopper adapted to deliver a flow of gas during pouring of molten metal, the stopper comprising, a lower end, a gas discharge port at the lower end, and an internal surface defining an internal chamber and a bore, the internal chamber having a floor towards the lower end of the stopper, the bore comprising a calibrating rod and fluidly connecting the internal chamber and the gas discharge port, the calibrating rod extending at least to the floor of the internal chamber and comprising at least one gas passage having a section with a predetermined resistance to the flow and a cross-sectional area less than 10 $mm^2$, the process comprising:

a) introducing a refractory material into an appropriate mold, b) pressing the refractory material into the mold;

c) removing the pressed stopper from the mold;

d) firing the pressed stopper; and e) introducing the calibrating rod into the bore.

13. Process of claim 11, further comprising enlarging the bore before inserting the calibrating rod.

14. Process of claim 11, further comprising connecting the calibrating rod to a gas supply line.

15. Stopper of claim 1, wherein the calibrated rod includes a plurality of gas passages.

* * * * *